US008831255B2

(12) United States Patent
Crawford et al.

(10) Patent No.: US 8,831,255 B2
(45) Date of Patent: Sep. 9, 2014

(54) AUGMENTED REALITY (AR) AUDIO WITH POSITION AND ACTION TRIGGERED VIRTUAL SOUND EFFECTS

(75) Inventors: David W. Crawford, Long Beach, CA (US); Amber Samdahl, La Canada Flintridge, CA (US); Jeffrey Voris, Pasadena, CA (US); Istvan B. Kadar, Glendale, CA (US); Kenny Mitchell, Edinburgh (GB)

(73) Assignee: Disney Enterprises, Inc., Burbank, CA (US)

( * ) Notice: Subject to any disclaimer, the term of this patent is extended or adjusted under 35 U.S.C. 154(b) by 338 days.

(21) Appl. No.: 13/415,128

(22) Filed: Mar. 8, 2012

(65) Prior Publication Data

US 2013/0236040 A1 Sep. 12, 2013

(51) Int. Cl.

| | |
|---|---|
| ***H04R 5/02*** | (2006.01) |
| ***H04R 5/00*** | (2006.01) |
| ***A63B 67/00*** | (2006.01) |

(52) U.S. Cl.

USPC ..... 381/309; 381/17; 381/310; 381/26; 463/49; 463/56

(58) Field of Classification Search

CPC ..... G11B 20/10527; G11B 27/105; G11B 27/034; G06F 3/16; H04H 60/04; H04R 25/552; H04R 25/00; H04R 25/502; H04R 25/70; H04R 25/30; H04R 25/505; H04R 5/003; H04R 1/1008; H04R 5/027; H04R 3/005; H04S 1/005; H04S 2420/01; H04S 2400/01; H04S 3/00; H04S 1/00; H04S 1/002; H04S 1/007; H04S 7/304

USPC ..... 700/94; 381/1, 17, 23.1, 26, 60, 309, 381/310, 312–331; 463/1, 2, 35, 48, 49, 56

See application file for complete search history.

(56) References Cited

U.S. PATENT DOCUMENTS

| | | | |
|---|---|---|---|
| 5,662,523 A | 9/1997 | Yasumaru et al. | |
| 8,469,824 B1 * | 6/2013 | Farley et al. | 463/53 |

(Continued)

FOREIGN PATENT DOCUMENTS

| | | |
|---|---|---|
| JP | 8047081 A | 2/1996 |
| KR | 20030071040 A | 9/2003 |
| WO | 2008077981 A1 | 3/2008 |

OTHER PUBLICATIONS

Moustakas et al, "Eidola an interactive augmented reality audio-game prototype", Oct. 2009, Audio Engineering Society.*

(Continued)

*Primary Examiner* — Vivian Chin
*Assistant Examiner* — David Ton
(74) *Attorney, Agent, or Firm* — Marsh Fischmann & Breyfogle LLP; Kent A. Lembke

(57) ABSTRACT

An augmented reality (AR) audio system for augmenting environment or ambient sound with sounds from a virtual speaker or sound source positioned at a location in the space surrounding an AR participant. The sound from the virtual speaker may be triggered by an action of the listener and/or by the location or relative orientation of the listener. The AR audio system includes stereo earphones receiving an augmented audio track from a control unit, and binaural microphones are provided to capture ambient sounds. The control unit operates to process trigger signals and retrieve one or more augmentation sounds. The control unit uses an AR audio mixer to combine the ambient sound from the microphones with the augmentation sounds to generate left and right ear augmented audio or binaural audio, which may be modified for acoustic effects of the environment including virtual objects in the environment or virtual characteristics of real objects.

19 Claims, 5 Drawing Sheets

(56) References Cited

U.S. PATENT DOCUMENTS

| | | | | |
|---|---|---|---|---|
| 2003/0035551 | A1 | 2/2003 | Light et al. | |
| 2004/0235545 | A1 | 11/2004 | Landis | |
| 2005/0255817 | A1 | 11/2005 | Edeler | |
| 2008/0008342 | A1 * | 1/2008 | Sauk | 381/315 |
| 2009/0046140 | A1 | 2/2009 | Lashmet et al. | |
| 2010/0034404 | A1 * | 2/2010 | Dent | 381/310 |
| 2010/0111337 | A1 | 5/2010 | Silber et al. | |
| 2012/0093320 | A1 * | 4/2012 | Flaks et al. | 381/17 |
| 2012/0114132 | A1 * | 5/2012 | Abrahamsson et al. | 381/74 |
| 2012/0207308 | A1 * | 8/2012 | Sung | 381/17 |
| 2013/0217488 | A1 * | 8/2013 | Comsa | 463/31 |

OTHER PUBLICATIONS

Vesa, Sampo, "Studies on Binaural and Monaural Signal Analysis—Methods and Applications," TKK Dissertations in Media Technology, Espoo 2009, Dec. 4, 2009.

Peltola, Mikko, et al., "Augmented Reality Audio for Location-Based Games," Helsinki University of Technology, Espoo, Finland, 35th International Conference: Audio for Games (Feb. 2009).

Rumsey, Francis, "Audio in Multimodal Applications," J. Audio Eng. Soc., vol. 58, No. 3, Mar. 2010.

Moustakes, Nikos, et al., "Interactive Audio Realities: An Augmented/Mixed Reality Audio Game Prototype," Audio Engineering Society Convention Paper, presented at the 130th Convention May 13-16, 2011, London, UK.

Lemordant, Jacques, "W3C workshop: Augmented Reality on the web," author manuscript, Barcelona, Spain 2010, hal-00494276, version Jun. 1-22, 2010.

Harma, Aki, et al., "Augmented Reality Audio for Mobile and Wearable Appliances," Journal Audio Eng. Soc., vol. 52, No. 6, Jun. 2004.

Tikander, Miikka, et al., "Binaural Positioning System for Wearable Augmented Reality Audio," 2003 IEEE Workshop on Applications of Signal Processing to Audio and Acoustics, Oct. 19-22, 2003, New Paltz, NY, pp. 153-156.

* cited by examiner

AUGMENTED REALITY (AR) AUDIO WITH POSITION AND ACTION TRIGGERED VIRTUAL SOUND EFFECTS

BACKGROUND

1. Field of the Description

The present description relates, in general, to augmented reality (AR) audio provided with mobile and wearable user devices, and, more particularly, to methods and systems for augmenting ambient audio and sounds with a virtual speaker selectively providing sound effects based on trigger events.

2. Relevant Background

For many years, there has been an expansion in the use of augmented reality (AR) to provide a unique and enjoyable entertainment experience. AR typically involves providing a live displayed experience of a physical, real-world environment in which the real-world elements are augmented by computer-generated sensory input. It may be thought of as an extension of virtual reality where a player immerses himself into a physical environment in which physical laws and material properties no longer have to be maintained. In a typical AR application, the real world or surrounding environment is simply enhanced in some way.

The augmentation or enhancement provided by the AR system may be video or data. For example, a video of an animated character may be displayed on a monitor or headset screen as an overlay to the real world the participant or user is viewing. Recently, in sports, graphical overlays such as first down markers in football and strike zones in baseball have been provided in a live feed of a game to augment the viewer's experience and enjoyment of the game. Similarly, many mobile devices equipped with global position satellite (GPS) and cameras are equipped to overlay data related to the present position of the mobile device upon the image of the environment provided by the camera. An AR system or device may also provide sound as an augmentation. For example, the displayed animations or data may be accompanied by digital tracks of music, speech, or sound effects.

There remains a need, however, for creating triggered audio streams or effects anywhere within a physical environment. Preferably an AR audio system may be provided that allows audio effects to be triggered by a relative position and/or location of a participant or user of the AR system and without a restriction on space (e.g., the user is free to move about a large area) and without detrimental effects to the ambient audio or sounds. Additionally, it is preferable that the sounds be projected at a correct three dimensional (3D) location relative to the participant/user and that the audio augmentation be provided so as to account for the environment about the participant/user, e.g., both the physical and virtual environmental characteristics.

SUMMARY

Briefly, the present invention addresses the above problems by providing an augmented reality (AR) audio system that augments environment or ambient sound with sounds from a virtual speaker or sound source with a three dimensional (3D) space position relative to the listener. The sound(s) from the virtual speaker are typically triggered by an action of the listener and/or by the location or relative orientation of the listener. For example, a listener may hear a virtual sound when they walk near to a particular part of a physical environment or when they operate an input device (e.g., pull a trigger on a toy weapon or the like initiating a sound effect), and these virtual sounds are mixed with or overlaid upon the ambient or environment sounds, which may be recorded and played back or allowed to pass through unimpeded or with some amount of filtering.

The AR audio system may include stereo earphones receiving an augmented audio stream or track from a control unit. Left and right ear microphones are provided on the left and right ear units/speaker housings to receive ambient sounds in the environment around the wearer of the earphones and to convert the sound or sound waves into electric signals that are transmitted in a wired or wireless manner to the control unit. One or more sensors may also be provided on the left and right ear units to sense an external input or trigger such as receipt of an infrared (IR) signal indicating a user input has been activated (trigger pulled on a toy weapon) or the earphone wearer has passed a trigger object (e.g., a statue or robot transmits an IR signal to the IR sensor to indicate proximity of the wearer in the physical environment).

In response, the sensor(s) transmits a trigger signal to the control unit, and the control unit operates to process the trigger signal and retrieve one or more augmentation sounds (e.g., a pre-rendered digital track corresponding to a virtual noise or sound effect). The control unit then uses an AR audio mixer (e.g., a binaural transfer function module) to combine the ambient sound from the left and right microphones with the augmentation sounds to generate left and right ear augmented audio (or AR audio output) that is provided in a wired or wireless manner to the left and right speakers of the stereo earphones. In this manner, the wearer of the earphones hears virtual sounds from a virtual speaker or sound source concurrently with sounds from the physical environment, with the virtual speaker being positioned at a physical location within the environment relative to the wearer or participant in the AR experience.

In some embodiments, a sensor assembly is provided on the stereo earphones worn by the participant to facilitate determination of a physical location of the wearer (e.g., a GPS coordinate or a more accurate location in a physical environment achieved with external sensors) and/or an orientation of the wearer's head (e.g., head movement tracking devices may be used to determine which direction in the environment the wearer/AR participant is facing), and the control unit selects the appropriate augmentation audio track or segment based on the wearer's physical location and/or actions in the environment and/or their orientation of their head.

Some of the contributions provided by or in the AR audio systems described herein include: (1) a robust infrared emitter and receiver location method; (2) novel environment aware augmented sound modeling; (3) enhanced reality audio augmentation; (4) augmented psychophysical aural simulation; and (5) real-time modular audio wave propagation.

More particularly, a method is taught that provides augmented audio to a listener (or AR participant) wearing a headset including right and left ear speakers (e.g., headphones with right and left speakers). The method includes, with binaural microphones on the headset, capturing ambient sound in an environment about the headset, and this ambient sound may be streamed or stored in media storage (temporarily for processing). The method further includes, from a sensor array worn or carried by the listener, receiving a trigger signal. Then, the method involves, with a track selection module, selecting an augmentation audio track in response to the trigger signal. For example, a number of pre-rendered sound tracks or sound effects may be stored in media or data storage accessible by the processor running the track selection module.

The method further includes, with a processor running an augmented reality (AR) audio mixer (e.g., a software program providing a binaural transfer function), combining the captured ambient sound with the selected augmentation audio track to generate an AR audio output track. Then, the method includes playing the AR audio output track with the right and left ear speakers of the headset. The selected augmentation audio track has binaural characteristics associated with a virtual speaker located relative to the listener's headset in the environment (e.g., the augmentation track may provide a sound or effect that sounds to the listener as if it originated from a source positioned at a particular physical or 3D location within the surrounding environment).

In some embodiments, the method further includes the step of isolating the listener from the ambient sound during the playing of the AR audio output track. In implementing the method, the sensor array may include an infrared (IR) receiver that outputs the trigger signal in response to receiving an IR signal from an IR transmitter on a user input device actuated by the listener (e.g., a toy weapon or the like triggered by the AP participant). In such embodiments, the IR receiver may include a left IR sensor and a right IR sensor positioned within the headset proximate to the left and right ear speakers, respectively, such that the virtual speaker can be positioned by the AR audio mixer relative to the listener's headset based on processing of the trigger signal. Further, the method may call for a second IR signal to be received as a reflected IR signal, from an object in the environment, of an IR signal output from the IR transmitter of the user input device. In such embodiments, the virtual speaker is co-located with the object in the environment by the AR audio mixer (e.g., the sound effect added to ambient sound is output from a virtual speaker coinciding with the location of the object reflecting the IR beam/signal).

In implementing the method, the sensor array may further include at least one head tracking sensor operating to transmit signals corresponding to a location of the headset in the environment. In such cases, the processor operates to set or define a location (X-Y-Z coordinates in the environment) of the virtual speaker relative to the location of the headset determined based on the head tracking sensor signals.

There are some implementations of the method where it is useful to improve or change the output by accounting for effects of the physical environment on the output from the virtual speaker or sound source and even for effects of virtual elements or characteristics of the AR environment/space. With that in mind, one of the selected augmentation audio tracks and the captured ambient sound(s) can be modified (during the combining step) based on an acoustic signature of the environment. For example, the acoustic signature may define (or take into account) effects corresponding to at least one of attenuation, reflectance, absorption, scattering, transmission, occlusion, diffraction, and Doppler shift. In some implementations of the method, the environment "includes" at least one virtual object or parameter, whereby the acoustic signature of the environment includes at least one virtual acoustic effect. For example, a wall made of wood may be virtualized to "sound" like it is made of stone or not even be a wall (e.g., a painting or representation of a canyon may cause echoes different than a physical wall). In such cases, the virtual parameter may be a material of a physical object in the environment (virtual parameter is that an object is made of metal not Plaster of Paris or the like) or may be a virtual geometry differing from a physical geometry of a portion of the environment (a wall may be projected with video representing a body of water or an open space). Then, the AR audio mixer provides audio environmental effects including occlusion and reflectance that differ from real audio effects in the real or surrounding physical environment.

DETAILED DESCRIPTION OF THE PREFERRED EMBODIMENTS

Figure 1:
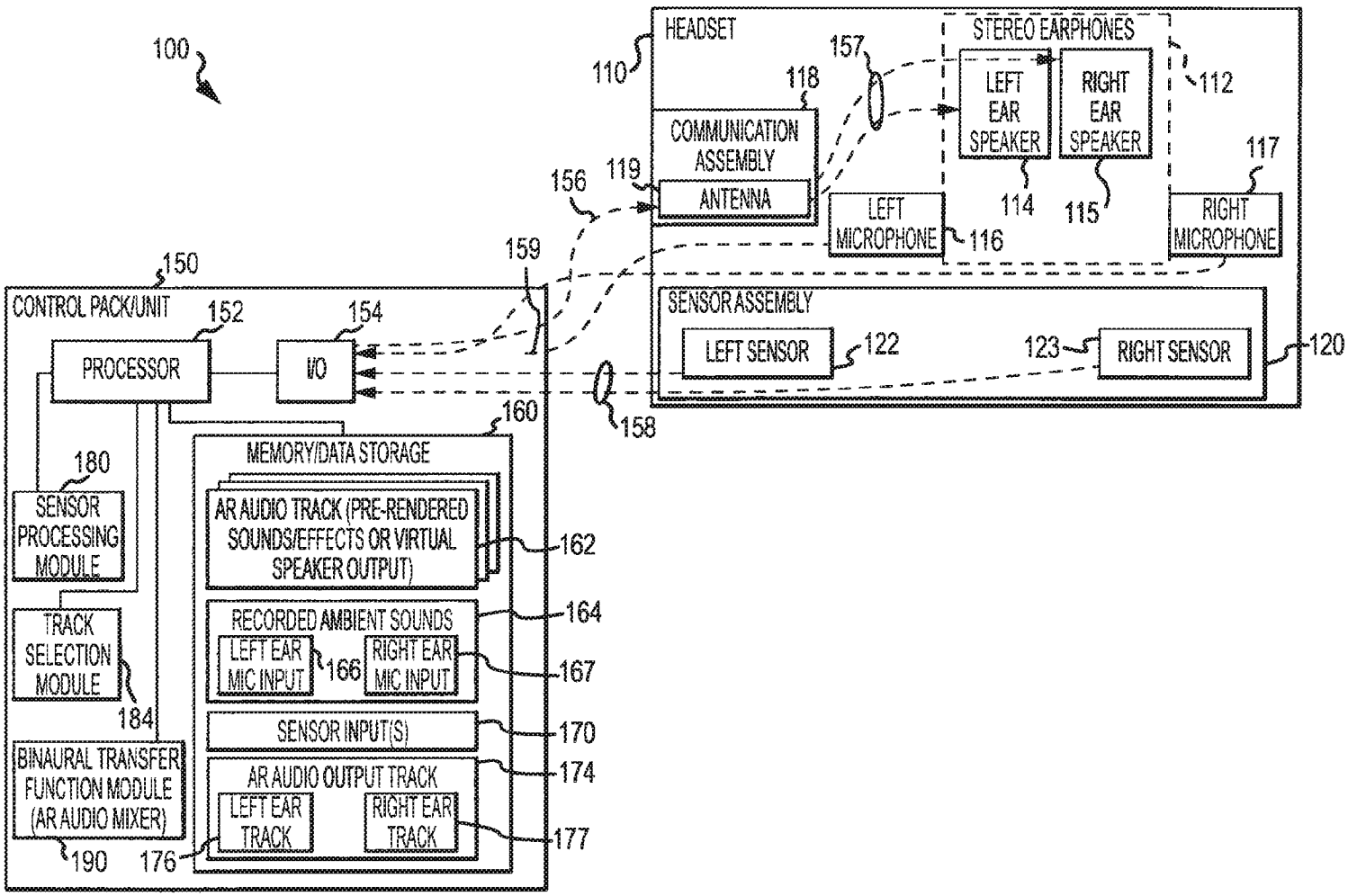
FIG. 1 is a functional block diagram of an augmented reality (AR) audio system (or, more simply, augmented audio system) of an embodiment of the description.

In a typical augmented reality (AR) system, a camera captures or records a real environment then uses a computer to incorporate digital images into a hybrid video image that is displayed back to the viewer or participant in the AR experience. In these prior AR systems, the sounds were typically fixed and played based on a timeline without regard to the location/actions of the participant and/or the participant had to remain in a fixed or known location within the AR space.

The inventors recognized that there previously had been no way to create triggered audio streams or effects in an AR system. Particularly, the inventors understood that AR systems could be significantly improved by allowing a virtual speaker or sound source to be provided anywhere within the AR space or environment and by configuring the AR system such that the sounds or the audio special effects provided by this virtual speaker(s) could be selectively triggered or initiated. Still further, the AR system can be enhanced by providing the virtual speaker without detrimentally affecting ambient audio and sounds (e.g., clearly hear your friend speaking next to you during the AR experience). The label "virtual speaker" is used because the sounds or audio effects appear to come from a particular 3D location within the real environment or surrounding physical space such as from a character cheering or yelling from a position a distance in front, in back, or to the side of the participant or such as a toy weapon held by the participant firing (e.g., "bang" coming from a location a short distance from the participant's right or left shoulder).

Briefly, the following description teaches an AR audio system (or an augmented audio system or assembly) that acts to selectively mix or overlay sound or audio tracks with sound captured or recorded from the space or physical space (ambient or environment sounds). The added sounds can be considered or labeled augmentation audio (or AR audio tracks) that is mixed or added such that it is sensed by the listener as being output from a particular location coinciding with the 3D or "physical" location of the virtual speaker within the environment or surrounding physical space. In other words, the AR audio system acts to incorporate digital audio tracks and/or effects instead of video/images to provide a unique and new AR experience, which may be used to support an entirely new category of gaming and interactive experiences.

In operation, the AR audio system captures a binaural recording of the local sound environment and then incorporates pre-recorded (or pre-rendered) digital audio tracks and/or effects (AR audio tracks or augmentation audio). In this manner, the AR audio system functions to create a virtual speaker or virtual sound source anywhere within the local (or relatively distal) environment. The virtual speaker can be "positioned" at nearly any location (X-Y-Z coordinates relative to the participant's left and right ears) so that the AR participant hears the new sounds "output" from the virtual speaker from a specific position or a plurality of positions if the virtual speaker is in motion relative to the participant. The virtual speaker may be "operated" to output the sound(s) at a particular time or in response to a trigger signal as though the source of the sound is present in, the real or physical environment with the AR participant.

The AR audio systems described herein may utilize, for example, a binaural headphone (or earphone) assembly or unit that has integrated left and right microphones for recording and/or capturing (without recording when passed through with or without filtering) ambient sounds. The microphones may be positioned proximate to the left and right speakers of the headphone/earphone assembly but be isolated (with regard to sound) from the earphone speakers. Then, the AR audio system functions to combine the ambient audio with processed, pre-recorded digital tracks or sound effects to generate a single audio stream (with right and left ear portions), and this AR audio output track or stream is sent to the user's right and left ears via the right and left speakers of the headphone/earphone assembly. In some embodiments, the pre-recorded audio (augmentation audio) may be replaced with live broadcast of sound or audio (e.g., the augmentation audio may take a number of forms to practice the AR audio system and is not limited to pre-rendered or pre-recorded digital tracks).

Integrated sensors allow for unique applications where environmental changes or participant actions trigger specific audio effects to be played or mixed into the captured/recorded ambient sounds. For example, one may imagine a toy gun that is operated by the AR participant (e.g., a trigger is pulled) and the AR participant hears a virtual explosion or bang or other personalized effect when the trigger pull is sensed by the sensor assembly. In another case, an AR participant may be listening to a personal music player (e.g., the augmentation audio is the music) without it affecting their ability to hear people, cars, or other ambient sound that is mixed with or without filtering into the AR audio output track provided to the right and left ear speakers. In another example, the AR participant may be provided a personal radar/sonar-type locator (e.g., a toy representation of such a device or simply a detection of the relative position of the AR participant's head) and go on a treasure hunt or similar activity. Such an application would allow the AR audio system to selectively provide informational audio tracks (e.g., quicker/slower, louder/softer beeps) in the AR audio output when the AR participant moves their locator/detector device nearer/farther to the hunted object and/or points the device at/away from the hunted object.

The 3D location of the virtual speaker within the surrounding space or environment about the AR participant may be determined or set in a number of ways. For example, the location of the pre-recorded sounds or other augmentation audio may be determined by line-of-sight sensors/triggers, by using a GPS/compass device(s) in the headphones to locate the user relative to the location of the desired sound, or by another useful technique. In some embodiments, pre-recorded audio is then selected or retrieved based on the trigger signal (or processing of input from a sensor assembly) and is processed through a binaural transform function or AR audio mixer with the captured ambient sounds prior to being played, via the headphone/earphone right and left ear speakers, to the AR participant. The AR participant perceives the sound from the virtual speaker as coming from the desired location (e.g., X-Y-Z coordinates of a virtual speaker) such as in front or in back of the AR participant, to the left or right of the AR participant, or above or below the AR participant's head location in the AR space/environment (which is typically quite, large and follows the movements of the AR participant versus a limited AR cubicle (as used in video-based AR systems) or the like).

FIG. 1 illustrates a functional block diagram of an AR audio system 100 that may be used to provide an AR experience to each AR participant. The AR audio system 100 includes a headset (or wearable assembly) 110, which includes stereo earphones (or headphones) 112 that provide a left ear speaker 114 and a right ear speaker 115 for playing an AR audio output track from a control pack or unit 150 (as shown at 156, 157, and 174). Typically, the stereo earphones 112 are worn by a user or AR participant (not shown in FIG. 1) such that the left ear speaker 114 is proximate to their left ear and the right speaker 115 is proximate to their right ear (or vice versa in some cases may be useful).

Significantly, the headset 110 further includes a left microphone 116 positioned near (e.g., within about 1 to 3 inches) the left ear speaker 114 and a right microphone 117 positioned near (e.g., within about 1 to 3 inches) the right ear speaker 115. The stereo microphones 116, 117 are typically isolated, with regard to sound, from the speakers 114, 115 such as by positioning on the external portion of a relatively sound proof or sound deadening housing containing the speakers 114, 115. The filtering or blocking of sound from passing from the environment to the speakers 114, 115 (or from speakers 114, 115 to microphones 116, 117) may be achieved structurally with sound barriers and/or electronically in some cases as is known in the electronics industry. The stereo microphones 116, 117 function to capture sound/noises from the environment/space about the headset 110, and the captured left and right ambient sounds are transmitted as shown at 159 to the control pack/unit 150 in a wired or wireless manner (e.g., via a communication assembly 118 that may include antenna 119 for transmitting/receiving signals to or from the control pack/unit 150).

The AR audio system 100 is adapted such that the captured ambient sound can be selectively augmented by additional sounds or sound effects (e.g., AR audio tracks 162). To trigger such selective audio augmentation, the headset 110 is shown to include a sensor assembly 120 that functions to transmit sensor signals/data/triggers, as shown at 158 to the control pack or unit 150, that are processed to determine when to augment the ambient audio and which augmentation audio to select to mix with ambient sounds/noise. For example, the sensor assembly 120 may include one or more devices for tracking head movements or orientation relative to a reference point in the environment (e.g., an object coinciding with a location of a virtual speaker to determine how close a headset 110 is to a virtual speaker and/or to determine whether the wearer has their head turned toward or away from the object/virtual speaker). In other cases, the sensor assembly 120 may include sensors such as GPS and/or compass-based sensing device for determining a location of a headset 110 and the relative orientation in an AR space or environment.

As shown, the sensor assembly 120 includes a left sensor 122 and a right sensor 123 providing sensor signals/output as shown at 158 to the control pack or unit 150, and these may take the form discussed above or as discussed in more detail below (e.g., infrared (IR) sensors for sensing receipt of an IR signal from a triggering object such as an IR beam being reflected back from a target and striking one or both of the sensors 122, 123). Use of independent sensors 122, 123, which are positioned proximate to (again, up to 1 to 3 inches from (or further, in some cases, as the location of the sensor is known and may be accounted for by the binaural transfer function module 190)) the speakers 114, 115, allows the control pack/unit 150 to determine relative locations of the headset wearer's right and left ears (e.g., relative to a virtual speaker) for use in generating a mixed or AR audio output track 174 that includes an added or augmentation audio 162.

As will be understood, a wide variety of sensors in sensor assembly 120 may be used to trigger augmented sounds as well as to synchronize and locate the augmentation sounds with events/spaces in the real or surrounding environment (e.g., with live or nearly live/real time sounds captured by microphones 116, 117). For example, the sensors 122, 123 may include one Or more GPS devices, digital compasses, gyros, radio frequency (RF) sensors, ultra sonic (US) sensors, IR sensors, visual recognition mechanisms (e.g., cameras and image processing software), and the like. The communication assembly 118 may provide for a wired link to the control pack/unit 150 and I/O 154 with digital signals including the captured audio from microphones 116, 117, the AR audio output track 174, and/or the sensor inputs 170 from sensors 122, 123. In other cases, the communication assembly 118 includes devices such as an antenna 119 for wireless communications of one or more of these signals as shown at 156 (e.g., receipt of the AR audio output track 174). For example, the communication assembly 118 may be a Bluetooth device (and/or the stereo earphones 112 may be Bluetooth stereo headphones), a WiFi device for communicating data over a wireless network, or the like.

The AR audio system 100 further includes a control pack or unit 150 that may be communicatively linked in a wired or wireless manner to the headset 110. In this way, the control pack 150 may be worn by the wearer or user of the headset 110 or the control pack 150 may be positioned remote to the headset 110 in the environment or AR space. The control pack/unit 150 includes a microprocessor(s) 152 or other computing device for managing operation of the input/output devices 154 used to receive signals/data from the headset 110 and transmitting an AR audio output track 174 to the left and right ear speakers 157 as shown at 156 (again, this may also be provided in a wired manner instead of via antenna 119).

The processor 152 also acts to run software (e.g., computer program or code adapted to cause the control unit 150 to perform particular actions, with the code stored in local memory/data storage such as memory device(s) 160). For example, the processor 152 runs a sensor processing module 180 that acts to process sensor inputs 170 received as shown at 158 by I/O device 154 and stored in memory 160. The sensor processing module 180 is adapted to suit the configuration of the sensor assembly 120 such as to process trigger signals 170 from an IR sensor 122, 123 or from an US or RF sensor 122, 123 (or antenna 119 for receiving such signals including GPS and WiFi signals or the like) or to determine orientation of the headset 110 (or the head of the participant wearing the headset 110).

During operation of the system 100, the left and right microphones 116, 117 operate to capture sounds that would be received by a wearer's left and right ears, respectively, if it were not for the use of the stereo earphones 112, and these are transmitted as shown at 159 to the I/O 154 of control pack 150. These are either streamed directly back to the speakers 114, 115 (as shown at 156, 157) with or without any processing (e.g., muting, filtering, modification, or the like) by software/electrical devices on the control pack 150 and with or without augmentation as an AR audio output track 174 with a left ear track 176 for playing by the left speaker 114 and with a right ear track 177 for playing by the right speaker 115. In other cases, the output of the microphones 116, 117 is at least temporarily stored in memory/data storage 160 as shown with recorded ambient sounds 164 that include sounds 166 from the left ear microphone 116 and sounds 167 from the right ear microphone 117.

The processor 152 further runs code to provide a binaural transfer function module or AR audio mixer 190 that, briefly, functions to combine the recorded (or streamed) ambient sounds 164 with any selected AR audio digital tracks 162 to create an AR audio output track 174. This track 174 includes a portion or left ear track 176 for playing by the left ear speaker 114 and a portion or right ear track 177 for playing by the right ear speaker 115 so as to provide binaural audio to the wearer of the stereo earphones 112. The binaural transfer function module 190 may take a variety of forms to provide this functionality, and the module 190 generally provides the AR audio tracks 162 in such a way that the virtual speaker providing these outputs 162 is properly located (with X-Y-Z coordinates relative to the location of the left and right ear speakers 114, 115) relative to the wearer or to the headset 110.

As described and shown, the stereo microphones 116, 117 can be used to record 164 or stream audio from the ambient environment in real time (or near real time with a minor delay for processing by binaural transfer function module 190). The computer and/or processor 152 in the control pack 150 is able to combine the ambient audio with pre-recorded tracks or sound effects 162 kept on a media storage device 160. The combined audio 174 is delivered to the user through the speakers 114, 115 of the earphones 112. The pre-recorded or pre-rendered media 162 may be processed through a binaural transfer function with module 190 (e.g., a media processor or media processing component of control pack 150). The module 190 gives the AR audio tracks 162 "binaural" properties and a sense of location within the actual or physical environment.

Further, in memory 160, a number of AR audio tracks or augmentation audio 162 are stored, and these may include pre-rendered sound effects or any other desired virtual speaker output for use in the AR audio system 100. The control pack 150 is also shown to include a track selection module 184 that is run by the processor 152 and acts, such as based on the output of the sensor processing module 180 indicating receipt of a particular trigger signal, to choose one or more of the AR audio tracks 162 to present to the speakers 114, 115 of the headset 110 in an AR audio output track 174. For example, the signal or sensor input 170 may indicate that a trigger of a toy weapon has been pulled/activated, and the selection module 184 may select an explosion or other personalized or fantasy weapon firing sound effect amongst the augmentation audio tracks 162.

Figure 2:
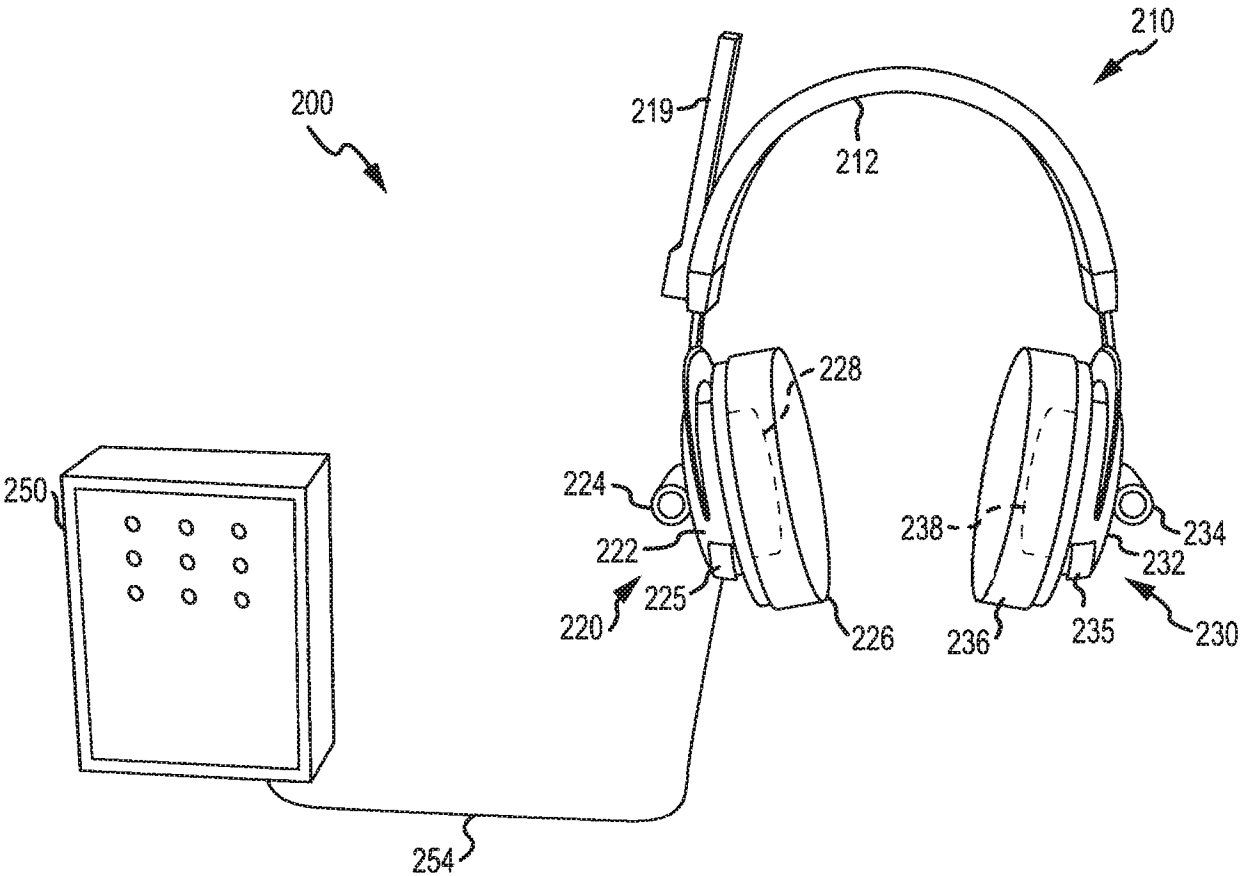
FIG. 2 illustrates an augmented audio system as described herein as may be used to implement the AR audio system of FIG. 1.

FIG. 2 illustrates one exemplary implementation of an audio augmentation assembly or system 200 that may be used to implement the concepts taught herein including the system 100 of FIG. 1. Briefly, the audio augmentation assembly 200 may be thought of as a wearable version of the system 100 with wired communications between, and power provided to, a control pack 250 and a headset 210 via line(s) 254. For example, a player of an AR game or participant in an AR experience may be provided the augmentation audio assembly 200 and wear the assembly 200 by placing the headset 210 on their head and placing the control pack 250 in a pocket or a provided harness/holster. Then, the AR participant may be free to walk about the AR environment, which may be relatively large, and the control pack 250 acts to feed augmented audio tracks to the participant via the headset 210.

The control pack 250 may include a power source to provide power to the components of the control pack 250 and also to components of headset 210 as needed. The control pack 250 provides processing functions and, to this end, may include one or more computer processing-type devices (processors and the like) and memory/data storage storing programs such as a binaural transfer function and track selection programs and also storing augmentation audio tracks and recorded ambient sounds.

The control pack 250 may thus be thought of as including media storage storing augmentation tracks and sound effects and also for temporarily storing recorded environmental sounds and further as including a media player for playing the augmented audio output on the headset 210. The augmented audio output is a mix or combination of the recorded/captured left and right ear ambient audio and, selectively, one or more augmentation audio tracks/effects. These added sounds or effects are mixed into the ambient sounds to create an accurate binaural audio output with the added or augmentation audio being virtually positioned at a location within the environment relative to the left and right speakers 226, 236 of the headset 210 (i.e., the participant's ears). To this end, the augmentation audio output by the control pack includes a left ear track or portion and a right ear track portion, which each include environmental sounds (filtered or unfiltered) and, when appropriate based on the processing by the sensor processing and track selecting processes, prerecorded or rendered sounds/effects to create an AR audio experience for the wearer of the headset 210.

The headset 210 includes a headband 212 that supports, at each end of its length, ear speaker units 220, 230. The speaker unit 220 includes a speaker housing 222, and a right speaker 228 is mounted on/in the housing 222 and covered with a pad 226 for comfort of the wearer. Similarly, a left speaker 238 is mounted in another speaker housing 232 provided in the speaker unit 230 and covered with a foam or other material pad 236. During use in an AR experience, the right speaker 226 plays right ear tracks of augmentation audio outputs from the control pack 250 while the left speaker concurrently plays left ear tracks of the augmentation audio outputs.

The headset 210 also is used to support and position sensors to use in determining when to augment the ambient audio and microphones for capturing the ambient/environment in the vicinity of the AR participant (wearer of headset 210). A first or right ear microphone 224 is mounted on the right ear housing 222 in ear speaker unit 220 and a second or left ear microphone 234 is mounted on the left ear housing 232 in ear speaker unit 230. The pair of microphones 224, 234 acts as binaural microphones for capturing ambient sound as if it were sensed or heard by the right and left ears of the wearer of the headset 210. The housings 222, 232 along with pads 226, 236 may be designed to provide at least some sound isolation between the microphones 224, 234 and the wearer's ears (or speakers 228, 238). In this way, the ambient sounds are wholly or at least partially provided in the output of the speakers 228, 238 by playing back the augmentation audio from control pack 250. The microphones 224, 234 may take many forms to practice the assembly 200 but are typically configured to capture the ambient sound in a similar manner as a human ear (e.g., with similar directionality constraints and the like).

The headset 210 further is shown to include a sensor array or assembly that includes a first or right sensor 225 and a second or left sensor 235. The right sensor 225 is attached to or supported by the right ear speaker housing 222 while the left sensor 235 is attached to or supported by the left ear speaker housing 232. By providing two sensors 225, 235 and placing them proximate to the wearer's ears, sensor signals that are processed by software/programs run by control pack are used to detect or identify triggering events for augmenting the ambient audio captured by microphones 224, 234 with one or more augmentation audio tracks or effects. For example, the sensors 225, 235 may be IR sensors that respond to receipt of an IR beam by transmitting a signal to the control pack 250. The triggering signals are processed, in part, to not only trigger addition of a sound effect or augmentation audio tracks but also to determine a relative position of the right and left ears of the wearer of the headset 210 relative to a "position" of a virtual speaker outputting these sound effects or tracks.

In other cases, it may be desirable to track orientation and/or location of the ear speaker housings 222, 232 (and, therefore, the wearer's ears and head) within an AR environment and/or relative to a "virtual speaker" in such an environment. To this end, the sensors 225, 235 may be selected for such purposes and/or the sensor array may include an antenna 219 to respond to RF, US, Bluetooth, WiFi, or other wireless trigger/event signals (such as those used by GPS devices) and responding to receipt of such transmissions by outputting a sensor/trigger signal to the control pack 250. The output of the sensor array such as trigger/sensor signals from sensors 225, 235 or a received trigger/signal or communication by the antenna 219 may be transmitted to the control pack 250 via line(s) 254 (or wirelessly in some cases via antenna 219).

To determine position/location of the virtual speaker, two pieces of information are typically used and may be determined using a variety of sensors. These pieces information are: (1) the direction/heading and (2) distance of the augmented sound from the user's head. Determining or obtaining this information can be accomplished in a variety of ways with a variety of sensors. For example, "global positioning system" could be used where the environment is mapped/known and the user's position within this environment is tracked with GPS, vision, or other type sensors. In another example, a "local positioning system" could be used where the sensors on the user determine this information such as by receiving a directional IR signal coded with time of flight information. In this manner, the system knows the user is pointed toward the sound (direction) and also knows the distance from the source (time of flight).

Figure 3:
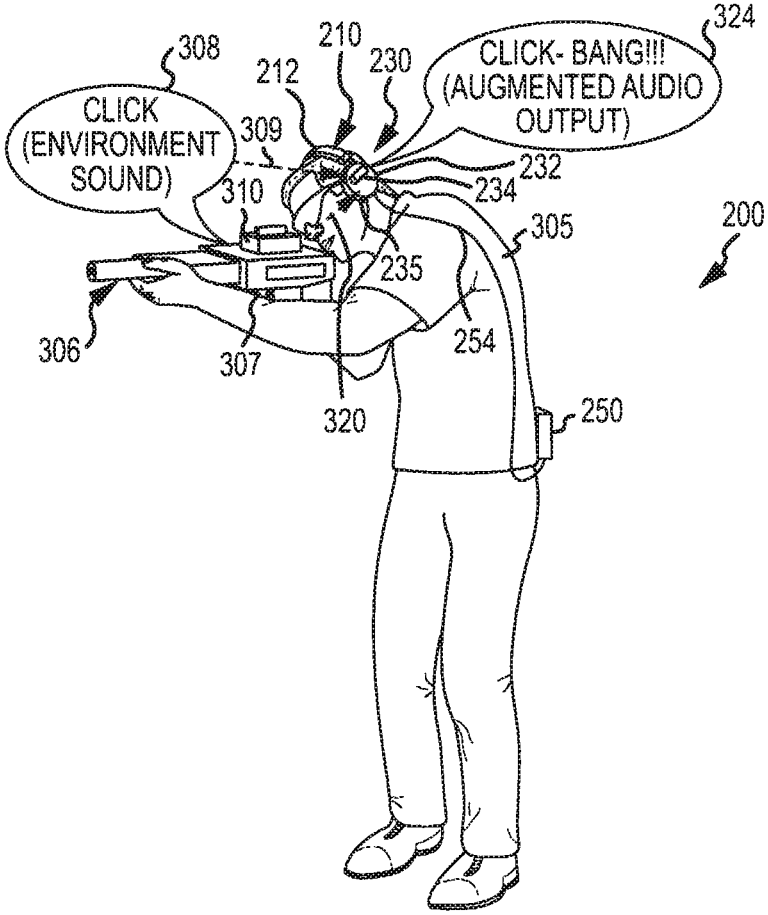
FIG. 3 illustrates the augmented audio system of FIG. 2 as it may be used in an application to augment ambient or environment sounds with an augmentation track (or pre rendered digital track) in response to a sensed input (e.g., presence of a trigger object nearby (e.g., walk near to an object identified as a "virtual speaker" for a sound triggered by proximity), interaction with a user input device such as a trigger upon a toy, and so on)

With an understanding of the operation of an AR audio system and an exemplary physical implantation, it may now be useful to describe several applications of such an AR audio system to create a new and unique AR experience. FIG. 3 illustrates an AR application or experience that involves the AR audio assembly 200 being used to augment audio for an AR participant 305 when the participant 305 operates a user input device. Particularly, ambient audio is augmented when the participant 305 operates the user input device 306, which is, in this case, in the form of a toy weapon or gun.

As shown, the input device 306 includes a trigger 307 (but, in other devices, this could be a button, a switch, a touch screen, or nearly any other input mechanism). When the trigger 307 is pulled or activated by the participant 305, the input device 306 operates an event indication element 310 to indicate to the sensor array on the headset 210 that the trigger was pulled. In some embodiments, the sensors 225, 235 on the headset 210 may be IR sensors and the event indication element 310 may be an IR transmitter operating in response to the pulling of trigger 307 by transmitting an IR signal (trigger/event signal) 320. This signal 320 is detected by the sensor 235 (and, in some cases, by sensor 225, not shown in FIG. 3).

The sensor 235 responds by transmitting a trigger/event signal to the control pack 250. The control pack 250 processes the output of the IR sensor 235 to identify a trigger pull by the participant 305 and to select an AR audio track (or augmentation audio effect) from data storage on the control pack 250 representative of a firing of the weapon/user input device 306. Concurrently, the left microphone 234 acts to capture the ambient sounds including any noise 308 caused by the pulling of the trigger 307 as shown at 309, and this ambient sound/noise 308 (shown as a "click" in this example) is transmitted via line 254 to the control pack 250 for streaming back to the participant 305 or recording.

The control pack 250 (or its processor and binaural transfer function module) functions to combine the capture ambient sound 308 with the selected augmentation audio track/sound effect, and this augmented audio (or AR audio output track) is played back to the participant, by a media player in control pack 250, via the headsets 210 and speaker units 220, 230 and shown at 324 (with a "click" from the environment followed by a "bang" from the media storage of control pack 250). In other embodiments, the "click" may also be an augmentation audio track or special effect and the "click" shown in playback audio 324 would instead only include other sounds/noises captured microphones 224, 234 (unfiltered in some cases or filtered/modified in other cases) such as another participant's speech or sounds broadcast into the AR gaming environment.

The augmented audio output 324 is provided to accurately position the virtual speaker, here the user input device 306 being "fired" by the pull of trigger 307, relative to the right and left speakers of the headset 210 (e.g., if the weapon 306 is placed on the right shoulder of the participant 305 as shown in FIG. 3, the virtual speaker providing the "bang" or augmentation sound effect would be closer to the right speaker (right ear) than to the left speaker (left ear) such that the "bang" or augmentation sound effect would be louder to and more quickly heard/sensed by the right ear of the participant 305).

Figure 4:
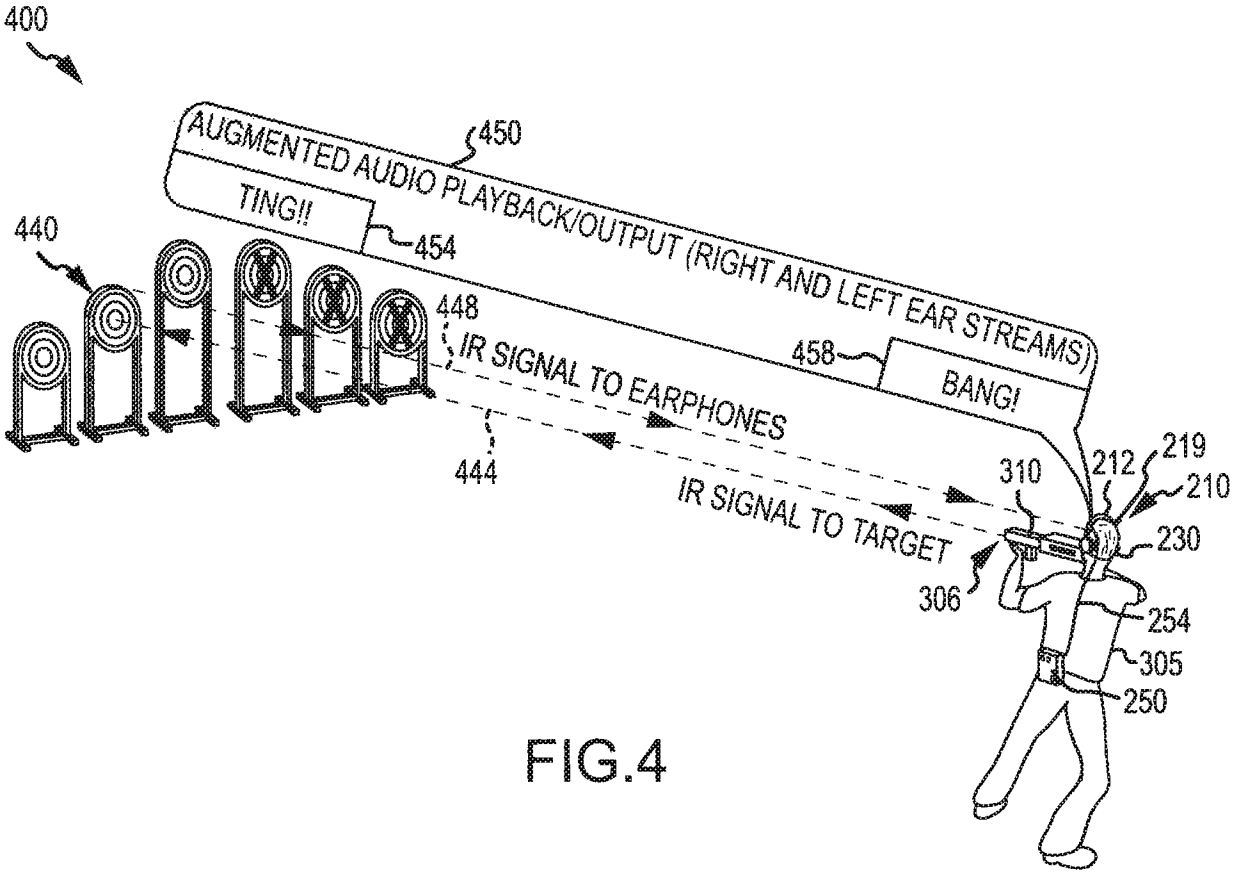
FIG. 4 illustrates an AR environment or system in which a participant utilizes an AR audio system such as that shown in FIGS. 2 and 3 to participate in an AR with two virtual sound sources or speakers at two different, spaced-apart positions in the physical environment (e.g., a firing weapon and a target distal to the participant)

FIG. 4 illustrates another application or use of the AR audio assembly 200 to provide an enhanced AR experience 400. In this example, the participant 305 is shown to be wearing the AR audio assembly 200 and to be operating the user input device/AR weapon 306. Particularly, the AR experience or environment 400 includes a number of targets 440 that can be used by the AR audio assembly 200 as virtual speakers to output augmentation audio tracks or sound effects from a particular location relative to the participant 305, e.g., any sounds emanating from the targets 440 are caused by the control pack 250 (and its processor(s) and software including the binaural transfer function) as sounding to the participant 305 as if they were coming from the 3D or X-Y-Z coordinates of the target 440 to the 3D or X-Y-Z coordinates of the participant 305.

As discussed with regard to FIG. 3, the control pack 250 acts to detect when the participant 305 has pulled the trigger 307 of the user input/weapon 306. Further, as shown, the user input/weapon 306 includes the IR transmitter 310 that in this example transmits an IR signal 444 along the barrel/target line of the weapon 306 when the participant 305 pulls the trigger or otherwise activates the weapon 306. A return IR signal 448 reflected from or transmitted from the target 440 is received by the sensor(s) 225, 235 of the headset 210. In this example, the control pack 250 functions by processing signals from the sensor array including sensors 225, 235 to detect multiple triggering events in the AR environment 400, and to select multiple augmentation audio tracks/effects from media storage to combine with the captured/recorded ambient sounds.

The output of the binaural transfer function is shown at 450 to include a first augmentation track/effect 458 ("bang") indicating a firing of the weapon 306 (which may be proceeded by a "click" or trigger pull noise provided as an augmentation sound or from the environment). Then, after a delay or calculated time period, the output 450 further includes a second augmentation track/effect 454 ("ting") indicating a target 440 has been hit or struck by the output of the weapon 306. The delay or spacing between the sounds 454 and 458 is selected based on a location of the participant 305 relative to the target 440 with more delay provided when there is a larger physical spacing and based on the weapon (firing bullets or arrows or an even slower moving projectile). The sound effects chosen for firing of the weapon 458 and striking the target 454 are also chosen based on the weapon 306 being simulated and the material of the target 440 and projectile "fired" by the weapon 306 (with the sound effects and their volumes being widely variable to practice the invention).

The sounds 454, 458 are provided in the right and left speakers of the headset 210 to provide desired binaural effects with the two virtual speakers in the correct relative location in the physical AR environment 400. For example, the weapon 306 would be the first virtual speaker providing the firing sound 458 from a location quite close (e.g., within a few feet) of the participant 305 (such as off of their right or left shoulder) while the target 440 would be the second virtual speaker providing the impact/target-striking sound 454 from a location distal (e.g., from several feet to many feet) from the participant 305. Further, the virtual speaker provided by the control pack 250 for the speaker 440 may be to the right or left of the participant 305 and also at the same height or above or below the participant (e.g., any X-Y-Z coordinates in the 3D space of the environment 400 such as from the various/differing targets 440 as each target may be associated with a different sound effect due to its location and/or material it is actually formed from or "virtually" formed of as the augmented audio added to the ambient may be realistic to simulate a metal target, a wood target, a glass target, or any material or even a more fanciful striking sound with the added sounds being nearly limitless to achieve a desired AR experience).

Figure 5:
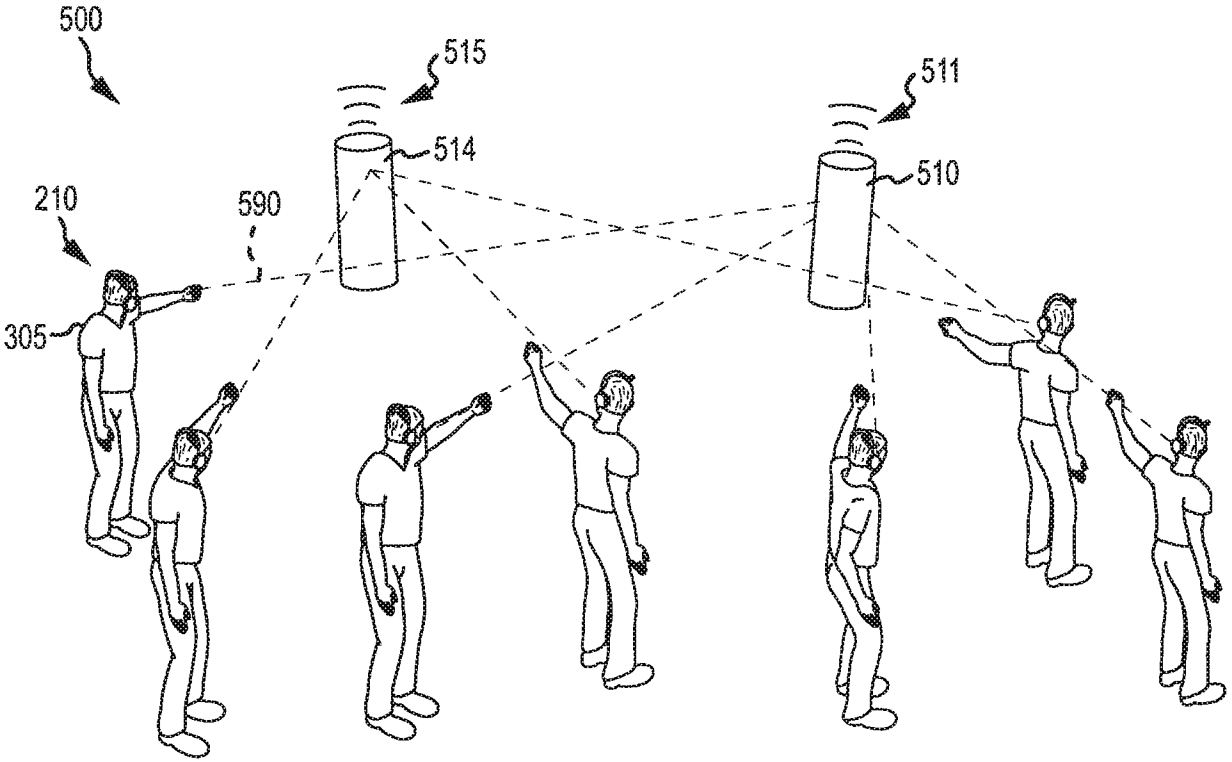
FIG. 5 illustrates an AR environment or system in which a number participants each utilize an AR audio system such as that shown in FIG. 2 to experience environment/ambient sound augmented by sound from a virtual speaker or source (e.g., a ticking or exploding bomb in this illustration or another trigger object/virtual speaker in the environment).

Numerous other AR activities and games may be provided with the AR audio systems taught herein. For example, FIG. 5 shows use of the AR audio assembly 200 by a number of or groups of player or participants in an AR experience/environment 500. Each participant. 305 is shown to wear the headset 210 and to be searching for a particular item in the AR environment. In one application, teams of the participants 305 are bomb squad teams searching for a particular ticking bomb as shown with bombs 510, 514 each making a ticking or activated sound 511, 515. The participant 305 provides a trigger signal for augmentation of the ambient sound by moving to a proximity of a bomb 510, 514 and/or by turning their head in a particular direction as shown at 570. The sensor array and control pack in such cases may be adapted to track physical location of the participant's head (and/or ears) relative to objects 510, 514 in the environment 500 and also to track head movements/positions via headset 210 and its sensors.

Such an AR application 500 may be used for other similar games or activities such as hide and seek, lost and found, capture the flag, hot/cold, treasure hunts, scavenger hunts, and the like that may be controlled as team play or individual play. As will be understood, team play is enhanced as each participant can hear the other team members via the captured/recorded ambient portion of the augmented audio output played in their headsets 210 and also to hear augmentation sounds that are personalized to suit their relative location in the space 500 to the virtual speakers (here, the bombs 510, 514) in the space 500 such that augmentation tracks/effects may differ or be provided in proper binaural manner to suit each player of a team (e.g., Player 1 hears the bomb 510 ticking 511 to his left while Player 2 hears bomb 510 ticking 511 to her right and so on).

As can be seen from the above description, the AR audio systems may be used to provide context-aware mobile augmented audio to AR participants. During operation, the AR audio systems may effectively combine use of pose-locating infrared sensors (or other sensors) and prior environment knowledge with binaural, occlusion, absorption, reflectance, diffraction, and transmission audio processing methods to provide an enhanced augmented audio experience. The AR audio systems allow augmented sound sources or virtual speakers to move freely through the scene (or AR environment or space) while still being auralized precisely for one or more participants who may be stationary or also moving through a mutable environment in real time (or near real time with minimal delays).

The augmented audio system mixes real sounds from binaural microphones with virtual sound sources to achieve not only realistic virtual sounds embedded in a real place and physical objects but also plausible virtual sounds embedded in an enhanced augmented version of the real space or AR environment (e.g., virtual objects may be added to the real physical environment that change the augmented audio output to the AR participant and/or textures and make up of physical items may be changed to effect the augmentation audio added to ambient source (e.g., a target may actually be formed of metal but its texture can be changed to glass virtually with changes to the selected augmentation audio track used when a target is hit)).

The inventors understood that their augmented reality audio is distinct from virtual reality audio in that the perception of real sounds in the participant's environment can be heard in addition to virtual sounds. Audio simulation with sound source spatial positioning and binaural modeling is common in mobile and wearable augmented reality audio ("MARA") experiences. Techniques, such as the use of head-related transfer function (HRTF), enhance the realism of perceived virtual audio sources, where the shape of a listener's head occluding sound pressure waves is taken into account.

However, such augmented auralizations do not account for the environment's aural signature as the inventors have done in at least some embodiments of the binaural transfer function module or AR audio mixer (such as module/mixer 190 of FIG. 1). More specifically, the mixing of the ambient sounds with selected AR audio tracks from media storage may take into account the influence of the presence of virtual objects and materials (or other virtual physical characteristics and parameters assigned to objects (real or virtual) in the AR environment about the AR participant) as sound occluders and reflectors. Mere mixing of virtual sounds with captured ambient sound may be useful in some AR applications, but, in others, the AR audio system is used to take into account the auralization effects from the environment for such augmentation audio tracks or effects (e.g., mixing/combining by AR audio mixer takes into account of auralization effects virtual and/or physical object in the AR participant's environment).

At this point in the description, it may be useful to discuss how the AR audio mixer or binaural transfer function module (or other software) in the AR audio system functions to augment environment/ambient audio with prior knowledge of the real physical environment around the participant. For example, the AR audio mixer may combine captured ambient sound with an augmentation audio track for a virtual speaker based on one or more of the following environmental sound consideration: attenuation, reflectance, absorption, scattering, transmission, occlusion, diffraction, and Doppler shift.

With regard to attenuation, audio compression waves may be thought of as attenuating approximately from point sources over the inverse distance squared law. In regular participating media, scattering and heterogeneous pressure effects also have an effect that is discernible mainly for loud noises over large distances where atmospheric conditions influence the attenuation of distant sounds. With this in mind, the AR audio mixer may include algorithms or routines that function to attenuate audio outputs from a virtual speaker.

With regard to reflectance, environmental reverberation may be applied that is broken into perceptual phases of early reflections (ER) and late reflections (LR). Early reflection impulse responses give rise to echo over longer distances and are perceived as separate sound peaks. Late reflections are composed of many wave fronts fused into a decaying amplitude envelope. Reverb is the product of pressure waves reflecting off surfaces in an environment. For example, an interior of a cathedral yields a vastly different audio environment from a bathroom while a stadium differs from a theater or open space due to the reflectance behavior of the location's geometry. Hence, it is often useful for the AR audio mixer to combine selected augmentation audio tracks from virtual speakers with ambient sounds by accounting for reflectance of the real world AR environment and/or the virtual aspects of such an AR environment.

Surface properties should also typically be taken into account for accurate simulation that adjusts for reflectance. Acoustic material reflectance is shaped by the properties of the material surface, including surface roughness against frequency band wavelength and surface hardness or tension. For example, a rubber surface is less reflective to audio waves than a stone surface. Also relevant to sound wavelengths, a clutter of papers on a desk may reflect more diffusely than a clear desktop. Correspondingly, diffuse and specular components of wave reflectance are present where diffusion may be modeled as a diffusion response of the incident wave angle and specular components modeled as a focused reflection angle response. Combined specular and diffuse responses may be represented by the AR audio mixer (or other software in the AR audio system) as a bi-directional reflectance distribution function (BRDF).

In some embodiments, the AR audio mixer utilizes a modular audio propagation transfer to combine the augmentation audio track/sound effect with the ambient sound. A full wave simulation may be applied, such as one taught in Modular Radiance Transfer, ACM Transactions on Graphics (Proceedings of ACM SIGGRAPH Asia 2011) 30, 6 (December), by Loos, B. J. et al., which is incorporated herein by reference. Such a full wave simulation may be used as one method for accurately recovering wave front propagation for precise reverberation auralization.

Briefly, a full wave simulation-based method approximates scene geometry into a series of connected blocks. Radiance transfer matrices are pre-computed according to energy transfers from reflections against walls inside each block and between blocks. A dictionary of blocks is created, where each block may include a different shape or configuration of omitted faces. This modular method may apply a regular dictionary of shapes pre-computed for optimized run-time processing by the control pack/unit of an AR audio system.

Pre-computed blocks are assembled to match the configuration of real spaces in the AR environment, with only dot product accumulation operations used to recover the full wave state at every point in the environment for moving sound sources such as the virtual speakers discussed herein. As a direct to indirect method, the number of audio sources or virtual speakers is independent of the run-time's indirect reflectance calculation, which allows the AR audio systems taught herein to provide many audio sources/virtual speakers rather cheaply with regard to processing. The resulting matrix operations optimize well for SIMD execution architectures that may be used to implement processor(s) and other aspects of the control pack/unit (or remote processing devices/servers in some embodiments).

In some embodiments, specular reflectance response is provided by use of one or more additional functions in the AR audio mixer such as a stable fluids method (e.g., Stable Fluids, in proceedings of SIGGRAPH 99, Computer Graphics Proceedings, Annual Conference Series, 121-128, 1999, authored by Stam, J., which is incorporated herein by reference) that may be used to accelerate the technique used in teaching such as Precomputed Wave Simulation for Real-Time Sound Propagation of Dynamic Sources in Complex Scenes, ACM Trans. Graph 29, 4, 2010, authored by Rachuvanshi, N. et al., which is also incorporated herein by reference.

An alternative approach for accounting for reflectance in the AR environment may synthesize or capture the environmental audio responses at a number of discrete locations such as in a grid of audio priors. A participant (wearing an AR audio system or assembly) moving between locations hears (as output from the control pack or unit) a mix of these priors through appropriate interpolation of reverberation effects to recover a continuous augmented audio environment for all navigable points or locations with the AR space or physical environment of an AR experience/application. Further, a convolution filter of such reverberation characteristics may be applied to moving sound sources attenuated by orientation and distance. Further occlusion and reflectance behaviors from connected locations may be recovered through a set of relative audio priors for each grid location and provided with the captured ambient sounds in the AR audio output track fed to the AP participant's headset and its left and right speakers.

Now, with regard to absorption, scattering, and transmission, it should be understood that surfaces of different materials (or other physical characteristics) absorb sound at different rates, which affects the amount of energy reflected in a physical space (or AR environment, in this description). An audio albedo is defined as the absorption rate of the material according to a range of audible frequency bands in analogy with the term applied to the visible spectrum. Subsurface material properties may scatter and hinder transmission of wave fronts or entirely block such as in the case of sound proofing materials.

Simple cases of augmented sound transmission through real thin surfaces, such as a glass window, may be simulated and incorporated in the above method/function used by the AR audio mixer in some embodiments of the invention. However, fully accurate calculation of such effects may require a volumetric representation and a more sophisticated BSSRDF (bidirectional surface scattering distribution function) model. Some data on volumetric acoustic material measures exist in the ultrasound field and may be used for accounting for absorption, scattering, and transmission effects in an AR environment.

The AR audio mixer may also include programming/code to account for occlusion. Occlusion from walls and partitions in an environment is a significant effect that can reduce the volume of sound sources, and it is useful to apply this effect to any virtual speakers positioned in an AR environment. A wave simulation with attenuation may be used to implicitly account for the reduction in volume of the output of a virtual speaker based on occlusion.

It may be useful to explain this function of an AR audio mixer of a control pack/unit by providing a particular example. A door opening constitutes a change in the occlusion of an audio environment. With the modular audio propagation method described above, such an event may be simply handled through the swapping of an open faced block with one that is closed. Thus, this permits a mutable augmented audio environment. In turn, the audio prior method described above may be used to interpolate between previously captured audio environments for the set of locations influenced by the proximity of the door. Additionally, the AR audio mixer may act to handle occlusion from other AR participants in the AR environment or space about a particular AR participant (e.g., performing relative participant tracking and applying occlusion to virtual speakers when another AR participant is positioned between a virtual speaker and the AR participant's head/ears) and/or to handle occlusion within generally deformable environments.

Now, with regard to diffraction, sound may be thought of as a pressure wave phenomenon that is subject to diffraction. The AR audio mixer may be configured to de-couple (or not couple) diffraction effects to a virtual speaker output from a reflectance simulation, but, in other embodiments including a full-featured wave propagation technique may couple these two differing effects on the augmentation audio track as part of combining it with ambient sound (which may also be modified/filtered to account for these environment factors or may be passed through as captured by the binaural microphones). The AR audio mixer may utilize a modular propagation scheme that implements a real-time wave simulation of diffraction events in the AR environment. Additionally, a grid of audio priors may include diffraction effects in the synthesized or captured representation (e.g., in the AR audio output track provided by the control pack/unit to the AR participant's headset).

Further, with regard to the Doppler shift, this sound property can affect where a change in frequency occurs through the motion of a sound source relative to the listener (or AR participant), and the AR audio system is adapted in some cases to augment the AR audio output track to account for these Doppler shifts. For example, frequency adjustment according to relative velocities of an emitter (virtual speaker) and a receiver (AR participant's left and right ears) may be made on a relatively simple basis. In more sophisticated embodiments, deltas between wave propagation states may be used to recover more accurate frequency shifts.

At this point, it may be useful to discuss the emitter (virtual speaker) and receiver (AR participant) pose locations. With known positions of the sound emitters and listening receiver, audio can be placed correctly within an AR environment by the AR audio system (e.g., through operation of the AR audio mixer or binaural transfer function module 190 of FIG. 1).

Further, the recovered or determined pose is used in some cases to place the synthesized audio correctly in the augmented environment (e.g., to place the output of the virtual speaker within an AR environment space relative to an AR participant's left and right speakers).

With this in mind, location of an emitter relative to a receiver may be computed through vision sensors. In one useful case, an IR emitter may communicate a trigger event (e.g., a trigger pull on an AR weapon). With knowledge of the context of this trigger event, the relative position of the emitter and the receiver may be inferred by the AR audio mixer. A strong IR source pattern can be readily tracked with an IR tracking sensor (provided on the headset, for example) to provide relative positions of virtual speakers and orientation of a participant's head relative to the location of the virtual speaker in the AR environment or space.

In other embodiments (or additionally), pose or orientation of an AR participant's head may be recovered or determined through image processing. For example, a video camera image stream may be processed using simultaneous location and mapping (SLAM) methods and/or using image marker-based tracking. For example, a video camera may be mounted on the AR participant's headset or otherwise positioned on the AR participant such that the relative position of the camera to the AR participant's left and right speakers is known. Then, by processing the image stream such as with image marker tracking, the listener's relative location and/or head orientation can readily be inferred or calculated (e.g., by the sensor processing module 180 of FIG. 1 or another set of software/processing routine).

To further understand aspects of the AR audio system and their operation, it may be useful to discuss how humans such as AR participants perceive audio particularly with regard to latency, noise, and other effects. When mixing augmented audio in a system with real sounds, it is desirable to match the timing of the real audio (captured ambient sound) with the synthetic audio from one or more virtual speakers or sources. A system that applies audio processing (such as binaural hear-through microphones) can easily become out of sync even with small lags of a few milliseconds. In the described AR audio systems, the binaural audio inputs are captured and, when the processed augmented results (AR audio output track) are presented to the listener, the ambient sounds (or binaural inputs being captured) are isolated from the listener. In this way, the output to the AR participant in their left and right ear speakers is augmented audio but it is independent of sensitive discrepancies between real sounds and the processed and augmented versions of those captured ambient/environment sounds. However, preferably, such processing is performed at real-time rates to maintain a pace with haptic and visual synchronization, e.g., pulling a trigger may allow for a short delay before hearing the gun shot or firing response.

Background noise from microphones and headsets can distract from an immersive experience. In some embodiments, a wireless cable free device assembly is used in the AR audio assembly. Depending on the application, noise cancelling may be applied with the headset to reduce low-level microphone noise. In an enclosed headset that occludes the AR participant's ear canals, the sound from the listener's voice, eating, and drinking may seem or sound strange and amplified to the AR participant. This effect may be countered through wave cancellation in a binaural microphone system. Another option may be to mask the AR participant's microphone-captured voice with a stylization by the AR audio mixer or other software to mask this effect according to a desired AR experience or application scenario. Further, the audio effects of wearing a headset may be an expected part of the use case, e.g., a pilot's helmet, a paintball game, or the like where a helmet or other headset is worn for safety or as part of the AR experience.

In the example of a very loud noise, such as a gunshot, the human ear often undergoes an involuntary ear canal muscle contraction. This contraction muffles hearing for a short time. While a really loud noise is typically not appropriate for an entertainment scenario, the psychophysical response may be simulated as though a really loud sound occurred such as by reducing the volume of the AR audio output track immediately following the "bang" or other loud noise. Further, subsequent ringing sensations from loud noise damage to stereocilia cells may also be simulated in an augmented audio scenario by selectively providing such sound effects after a "loud" noise or sound track.

Although the invention has been described and illustrated with a certain degree of particularity, it is understood that the present disclosure has been made only by way of example, and that numerous changes in the combination and arrangement of parts can be resorted to by those skilled in the art without departing from the spirit and scope of the invention, as hereinafter claimed. As can be seen from the above description, use of an AR audio system allows for real time integration of digital audio tracks and effects with ambient sounds and noise in an existing environment. Persistence of direction can be maintained for one person or even for a group of AR participants.

Further, the AR audio systems provide a number of advantages over any prior devices. New and interesting game play can be accomplished with the AR audio system, e.g., paintball (and other games) with real gun and battle noises (or other user input-based noises and game-relevant sound effects) provided in the augmentation audio while allowing the players to hear environmental sounds/noises (environmental audio). The AR audio system can be used to provide an individual music player such as to provide a soundtrack, mood music, or the like (music or a recorded book or the like is the augmentation audio mixed into the captured environmental audio) without impacting the user's ability to hear what is going on around them. This is in contrast to many present music playing devices where the environment audio is often drowned out by speaker outputs.

In some embodiments, an AR participant is provided personalized sound effects and not just the same sounds output to all people in a space. For example, the personalized sound effects may include augmentation audio corresponding to the AR participant's motions or actions (or use of an AR input device) such as wand, gun, martial arts, or other sound effects. The augmentation audio may be personalized, too, such as to allow an AR participant to hear audio appropriate for what they are looking at in a space (e.g., based on a signal from a sensor assembly that may, for example, track head movements/orientations). In such cases, the augmentation audio or added audio may fade back out when the AR participant looks away from the virtual speaker. An example of such audio may be a narrator speaking to the AR participant describing an observed object/scene (or providing navigation or other information about the environment) or objects may appear to be the virtual speaker (such as talking billboards, pictures, money, and so on). Hidden messages/audio tracks may be more effectively synchronized with environmental audio such as to assist a user of the AR audio system to follow a route or path with an audible signal indicating they are on the right path (to a known or unknown destination) and degrading when the user strays from the path(s).

In some cases, the environment sound(s) is not simply passed to the binaural transfer function module or AR mixing mechanism but is instead processed to provide an altered environment audio stream. For example, the ambient sounds from the left and right ear microphones may be processed to provide a voice changer so as to add reverb, distortion, echo, or the like to voices in the environment including that of the AR participant (as they hear their voice via the AR audio output track provided to the right and left ear speakers). In other cases, the pre-processing of the ambient sound prior to mixing with any selectively provided augmentation audio may involve sound calculation where the ambient audio is muted or filtered (fully or partially) and, in some cases, fully or partially replaced with the augmentation audio.

FIGS. 3 and 4 may be used to show a location-based paintball style game. In these implementations, gunshot reports, echoes, and reverberations may be simulated as part of the augmenting of the real audio from the toy gun so as to provide a more realistic experience. A more elaborate scenario may involve a series of rooms and corridors where the AR audio mixer functions as described herein to account for attenuation, reflection, absorption, scattering, transmission, occlusion, diffraction, and Doppler shift so as to better simulate gunshot (or other sounds) in a complex space.

Often, in location-based entertainment, facades and low cost materials are used to convey the appearance of a fantasy environment that may be used as an AR environment with the AR audio systems described herein. For example, a fresco matt painting or 3D display may visually place an AR participant next to a deep chasm or a long corridor when in fact a real physical wall is only a few feet away. In such cases, the AR audio track can be pre-rendered to suit this represented AR environment or modified as part of the combining to not take on the effects of the real AR environment but instead to take on the audio effects or audio signature of the intended fantasy or virtual AR environment so as to enhance suspension of disbelief by the AR participant.

Further, construction materials used in a real AR environment may differ significantly from the materials that are represented by the "set" of the AR environment. For example, Plaster of Paris or rubber may be used as cheaper alternatives to represent other materials such as a carved stonework, but these cheaper construction materials have much differing acoustic material and surface properties. In such situations, the AR audio system may utilize pre-rendered augmentation sounds that can be added to ambient to suit (with audio effect characteristics or parameters) the represented materials versus the actual materials or algorithms may be used to modify the selected audio tracks or sound effects prior to combination with captured ambient sounds (e.g., modify a generic "bang" to sound as if it were reflected off of a stone or wood wall rather than a Plaster of Paris surface). In such a case, a binaural capture of environment audio may also not be sufficient to produce the intended plausible auralization, and the knowledge of the differing acoustic properties of the virtual set or represented materials may be used to process and/or modify the captured sounds prior to playback (e.g., both the selected augmentation audio track and the captured ambient sound may be modified to suit the acoustic properties of the represented or modeled environment).

We claim:

1. A method for providing augmented audio to a listener wearing a headset including right and left ear speakers, comprising:

with binaural microphones on the headset, capturing ambient sound in an environment about the headset;

from a sensor array worn or carried by the listener, receiving a trigger signal;

with a track selection module, selecting an augmentation audio track in response to the trigger signal;

with a processor running an augmented reality (AR) audio mixer, combining the captured ambient sound with the selected augmentation audio track to generate an AR audio output track; and playing the AR audio output track with the right and left ear speakers of the headset, wherein the selected augmentation audio track has binaural characteristics associated with a virtual speaker located relative to the listener's headset in the environment.

2. The method of claim 1, further including isolating the listener from the ambient sound during the playing of the AR audio output track.

3. The method of claim 1, wherein the sensor array comprises an infrared (IR) receiver outputting the trigger signal in response to receiving an IR signal from an IR transmitter on a user input device actuated by the listener.

4. The method of claim 3, further wherein the IR receiver includes a left IR sensor and a right IR sensor positioned within the headset proximate to the left and right ear speakers, respectively, and wherein the virtual speaker is positioned relative to the listener's headset based on processing of the trigger signal.

5. The method of claim 1, wherein the sensor array further comprises at least one head tracking sensor operating to transmit signals corresponding to a location of the headset in the environment and wherein the processor operates to set a location of the virtual speaker relative to the location of the headset determined based on the head tracking sensor signals.

6. The method of claim 1, wherein at least one of the selected augmentation audio track and the captured ambient sound are modified during the combining step based on an, acoustic signature of the environment.

7. The method of claim 6, wherein the acoustic signature defines effects corresponding to at least one of attenuation, reflectance, absorption, scattering, transmission, occlusion, diffraction, and Doppler shift.

8. The method of claim 6, wherein the environment includes at least one virtual object or parameter, whereby the acoustic signature of the environment includes at least one virtual acoustic effect.

9. The method of claim 8, wherein the virtual parameter is a material of a physical object in the environment or is a virtual geometry differing from a physical geometry of a portion of the environment, whereby audio environmental effects including occlusion and reflectance differ from real audio effects in the environment.

10. A method for providing augmented audio to a listener wearing a headset including right and left ear speakers, comprising:

with binaural micro hones on the headset, capturing ambient sound in an environment about the headset;

from a sensor array worn or carried by the listener, receiving a trigger signal;

with a track selection module, selecting an augmentation audio track in response to the trigger signal;

with a processor running an augmented reality (AR) audio mixer, combining the captured ambient sound with the selected augmentation audio track to generate an AR audio output track; and playing the AR audio out rut track with the right and left ear speakers of the headset, wherein the selected augmentation audio track has binaural characteristics associated with a virtual speaker located relative to the listener's headset in the environment, wherein the sensor array comprises an infrared (IR) receiver outputting the trigger signal in response to receiving an IR signal from an IR transmitter on a user input device actuated by the listener, wherein a second IR signal is received as a reflected IR signal from an object in the environment of an IR signal output from the IR transmitter of the user input device and wherein the virtual speaker is co-located with the object in the environment.

11. An augmented audio apparatus, comprising:

a binaural audio headphone assembly including right and left earphones providing right and left speakers, respectively, wherein the headphone assembly further includes a left microphone on the left earphone and a right microphone on the right earphone; and a control pack communicatively linked with the headphone assembly, the control pack including media storage storing a plurality of augmentation audio tracks and further including a binaural transfer function module generating an augmented audio output track for playing on the right and left speakers, the augmented audio output track combining ambient sound captured by the left and right microphones with at least one of the augmentation audio tracks output from a virtual sound source positioned at a physical location relative to the headphone assembly, wherein the headphone assembly further comprises right and left sensors receiving signals from an emitter and responding by transmitting a trigger signal to the control pack and wherein the binaural transfer function module selects the at least one of the augmentation audio tracks based on the trigger signals and defines the physical location based on the trigger signals.

12. The apparatus of claim 11, wherein a space including the physical location of the virtual sound source includes physical objects defining a set of acoustic effects for a sound emitted from the virtual sound source and wherein the binaural transfer function modifies the at least one of the augmentation audio tracks based on at least one of the acoustic effects.

13. The apparatus of claim 12, wherein the at least one of the acoustic effects is chosen from the group consisting of attenuation, reflectance, absorption, scattering, transmission, occlusion, diffraction, and Doppler shift.

14. The apparatus of claim 12, wherein the binaural transfer function further modifies the at least one of the augmentation audio tracks or the captured ambient sound to apply an acoustic effect caused by a virtual object positioned in the space or an acoustic effect differing from a real acoustic effect of one of the physical objects in the space.

15. The apparatus of claim 11, wherein the headphone assembly is adapted to isolate the microphones from the speakers.

16. An augmented reality audio system, comprising:

a headset with a left speaker and a right speaker and with a left microphone mounted proximate to the left speaker and a right microphone mounted proximate to the right speaker; and a control unit communicatively linked with the headset, the control unit including an augmented reality (AR) audio mixer and media storage storing augmentation audio tracks, wherein the AR audio mixer selectively combines one of the augmentation audio tracks with environmental sound captured by the left and right microphones to generate an augmented audio output played on the left and right speakers and wherein the AR audio mixer modifies the one of the augmentation audio tracks based on an acoustic signature of an AR environment, wherein the headset includes a sensor array detecting an event in the AR environment and a relative location of the headset in the AR environment and wherein the control unit further includes a module for selecting the augmentation audio track to combine with the environmental sound based on the detected event.

17. The system of claim 16, wherein the acoustic signature defines effects of physical objects in the AR environment due to at least one of attenuation, reflectance, absorption, scattering, transmission, occlusion, diffraction, and Doppler shift.

18. The system of claim 16, wherein the acoustic signature defines effects of one or more virtual object or parameter in the AR environment due to at least one of attenuation, reflectance, absorption, scattering, transmission, occlusion, diffraction, and Doppler shift.

19. The system of claim 16, wherein the AR audio mixer modifies the selected augmentation audio track based on the relative location of the headset and a location of a virtual speaker provided in the AR environment to output the selected augmentation audio track.

* * * * *

UNITED STATES PATENT AND TRADEMARK OFFICE

CERTIFICATE OF CORRECTION

PATENT NO. : 8,831,255 B2
APPLICATION NO. : 13/415128
DATED : September 9, 2014
INVENTOR(S) : David W. Crawford et al.

It is certified that error appears in the above-identified patent and that said Letters Patent is hereby corrected as shown below:

In the Claims

Column 20, line 55, delete “micro hones” and insert therefore --microphones--.

Column 20, line 65, delete “out rut” and insert therefore --output--.

Signed and Sealed this
Fourteenth Day of April, 2015

Michelle K. Lee

Michelle K. Lee
*Director of the United States Patent and Trademark Office*